US006691660B2

(12) United States Patent
Silva, II et al.

(10) Patent No.: US 6,691,660 B2
(45) Date of Patent: Feb. 17, 2004

(54) GLOW PLUG ENERGIZING DEVICE

(76) Inventors: Frank W. Silva, II, 9124 Ernst Rd., Fort Wayne, IN (US) 46809; Larry E. Keeling, Jr., 6417 Birchdale Dr., Fort Wayne, IN (US) 46815

( * ) Notice: Subject to any disclaimer, the term of this patent is extended or adjusted under 35 U.S.C. 154(b) by 59 days.

(21) Appl. No.: 10/116,926

(22) Filed: Apr. 5, 2002

(65) Prior Publication Data

US 2003/0188706 A1 Oct. 9, 2003

(51) Int. Cl.[7] ..... F23Q 7/00; F23Q 7/16

(52) U.S. Cl. ..... 123/179.6; 123/142.5 E; 123/145 A

(58) Field of Search ..... 123/179.6, 145 A, 123/145 R, DIG. 3, 142.5 R; 219/270

(56) References Cited

U.S. PATENT DOCUMENTS

| | | | | |
|---|---|---|---|---|
| 1,763,443 | A | | 6/1930 | Righetto |
| 1,826,576 | A | | 10/1931 | Rump |
| 2,475,750 | A | | 7/1949 | McCormick et al. |
| 3,363,559 | A | | 1/1968 | Estes |
| 4,008,944 | A | | 2/1977 | Jackson |
| 4,110,629 | A | | 8/1978 | Dotson et al. |
| 4,130,853 | A | | 12/1978 | Baker |
| 4,177,785 | A | | 12/1979 | Sundeen |
| 4,183,341 | A | | 1/1980 | Eastman |
| 4,222,734 | A | | 9/1980 | Nolf |
| 4,274,034 | A | | 6/1981 | Conklin |
| 4,405,890 | A | | 9/1983 | Hicks, Jr. |
| 5,052,653 | A | | 10/1991 | Coraccio |
| 5,094,198 | A | | 3/1992 | Trotta et al. |
| 5,307,701 | A | | 5/1994 | Thonnard |
| 5,509,354 | A | | 4/1996 | Dorffler et al. |
| 5,676,100 | A | | 10/1997 | Dam et al. |
| 6,009,369 | A | | 12/1999 | Boisvert et al. |
| 6,085,711 | A | | 7/2000 | Gerst |
| 6,155,870 | A | * | 12/2000 | Valentine ..... 439/504 |
| 6,276,325 | B1 | | 8/2001 | Arlton |
| 6,342,690 | B1 | | 1/2002 | O'Donnell |

FOREIGN PATENT DOCUMENTS

| | | | |
|---|---|---|---|
| WO | wo-99/05455 | * | 2/1999 |

* cited by examiner

*Primary Examiner*—Henry C. Yuen
*Assistant Examiner*—Arnold Castro
(74) *Attorney, Agent, or Firm*—Butzel Long

(57) ABSTRACT

A glow plug energizing device for energizing glow plugs in glow ignition engines which includes a glow plug connector configured to be releasably coupled to a glow plug, at least one battery for supplying electrical energy to the glow plug connector, a housing containing the at least one battery, an electrical lead coupled between the housing and the glow plug connector, and a first manual switch coupled to the electrical lead for selectively applying electrical energy from the battery to the glow plug connector.

13 Claims, 4 Drawing Sheets

GLOW PLUG ENERGIZING DEVICE

TECHNICAL FIELD

The present invention relates to combustion engines for scale models that utilize glow plugs. More particularly, the present invention relates to an energizing device for starting glow plug equipped engines.

BACKGROUND ART

Engines used in model airplanes, cars, boats, etc. are referred to as "glow-ignition" engines because they rely on glow plugs for their operation. The glow plugs, which are located within a combustion chamber of the engines, are heated to ignite an air/fuel mixture within the combustion chamber.

In order to cause initial combustion within the combustion chamber of the engine, normally one pole of a small voltage battery is connected to the center pole of the glow plug and the other pole of the battery is connected to the glow plug body or to the engine head for completing an electrical circuit through the coil element of the glow plug. When the coil element becomes sufficiently hot to cause ignition of the fuel/air mixture within the combustion chamber the engine may be started. After sufficient engine heat is developed within the combustion chamber to keep the coil element hot, the battery or power source may be disconnected from the glow plug, and the engine heat itself will be sufficient to sustain operation.

There are many ways to connect battery leads to the glow plug of a combustion engine. One of the most common ways is the use of lead wires having alligator type clips associated therewith. With such an arrangement, one alligator clip is connected to the center pole of the glow plug and the other is connected to some metallic portion of the engine head. This method, while workable is undesirable and can even be dangerous. Unless great care is taken, the alligator clips may both come into contact with the cylinder head, thereby causing an electrical short. Further, usually associated with an engine of this sort is a fast turning propeller which may cause damage upon coming into contact with the electrical leads. Further yet, it is desirable for the leads to be disconnectable with one hand since the other hand is needed to hold the model in place after the engine is started.

Other attempts have been made to develop a single unit connector which connects one lead of the battery through the center pole of the glow plug and the other lead to somewhere on the engine body to complete the circuit. However, most of these units have been unsuccessful in withstanding the vibration normally associated with starting of a model airplane type engine.

U.S. Pat. No. 6,276,325 to Arlton discloses a glow plug connection for model engines that comprises a plug clip that can be attached and removed from a glow plug with one hand.

U.S. Pat. No. 4,405,890 to Hicks, Jr. discloses a rechargeable glow plug energized that includes a Headlock connector and a rechargeable battery in a single hand held assembly.

While the art of glow-ignition engines has advanced so that glow plugs can now be connected and disconnected from batteries for engine start-up, the art has failed to address a situation which arises when one attempts to start a cold engine or an engine having an air-to-fuel ratio that needs to be adjusted.

When starting a cold glow-ignition engine it is not uncommon for an engine to start with a battery connected to a glow plug and then fail, because of being cold, when the battery is disconnected. In other situations, it is not uncommon for an engine to start with a battery connected to a glow plug and then fail when the battery is disconnected, while trying to adjust the fuel/air ratio.

The present invention provides an energizing device for starting glow plug equipped engines which can prevent premature failure of the engines during start-up operations.

DISCLOSURE OF THE INVENTION

According to various features, characteristics and embodiments of the present invention which will become apparent as the description thereof proceeds, the present invention provides a glow plug energizing device which includes:

- a glow plug connector configured to be releasably coupled to a glow plug;
- at least one battery for supplying electrical energy to the glow plug connector;
- a housing containing the at least one battery;
- an electrical lead coupled between the housing and the glow plug connector; and
- a first manual switch coupled to the electrical lead for selectively applying electrical energy from the at least one battery to the glow plug connector.

The present invention further provides a method of starting a glow-ignition engine which involves the steps of:

a) providing a glow-ignition engine having a glow plug;

b) providing a glow plug energizing device which includes:
   - a glow plug connector configured to be releasably coupled to a glow plug;
   - at least one battery for supplying electrical energy to the glow plug connector;
   - a housing containing the at least one battery;
   - an electrical lead coupled between the housing and the glow plug connector; and
   - a first manual switch coupled to the electrical lead for selectively applying electrical energy from the battery to the glow plug connector;

c) coupling the glow plug connector to the glow plug;

d) activating the first manual switch to energize the glow plug;

e) starting the glow-ignition engine;

f) deactivating the first manual switch;

g) removing the glow plug connector from the glow plug.

BRIEF DESCRIPTION OF DRAWINGS

The present invention will be described with reference to the attached drawing which are given as non-limiting examples only, in which.

BEST MODE FOR CARRYING OUT THE INVENTION

The present invention is directed to an energizing device for starting glow plug equipped engines which includes a power source, electrical leads, an attachable/releasable glow plug connector having electrical terminals for coupling the power source to a glow plug, and a manual switch for selectively supplying energy from the power source to the glow plug through the electrical leads and the glow plug connector According to one embodiment of the present invention the power source and manual switch are provided in a common housing or case from which the electrical leads extend to the glow plug connector. In an alternative embodiment, the electrical leads can extend between the power source and the glow plug connector and the manual switch can be provided along the electrical leads at some convenient point.

For field use, the power source can be any type of battery or batteries including rechargeable and non-rechargeable batteries. When the battery or batteries and manual switch are provided in a housing or case, a simple electrical test circuit can be provide to verify that the battery or batteries is/are sufficiently charged. Such a test circuit can include a verification light and a test switch which, when activated, supplies power from the battery or batteries to the verification light.

The manual switch which selectively supplies energy from the power source to the glow plug, can be any type of switch including a toggle switch, a momentary switch, a rocker switch, slide switch, etc. According to one embodiment of the present invention, a manual switch such as a rocker switch or a depressible switch is used which can be moved in a simple smooth motion by one hand between an on and an off position. According to another embodiment of the present invention, a momentary switch is used which completes an electrical circuit when depressed and held and which disconnects the electrical circuit when released.

The glow plug connector includes a central electrical terminal for coupling to a first central conductor of a glow plug and an annular electrical terminal for coupling to an outer wall or end of the glow plug which serves as a second conductor of the glow plug. A platinum-alloy filament or coil is coupled between the first and second conductors of the glow plug. In order for the glow plug connector to be easily attachable/releasable to/from a glow plug the annular electrical terminal can be configured to clip onto the outer wall or end of the glow plug.

Figure 1:
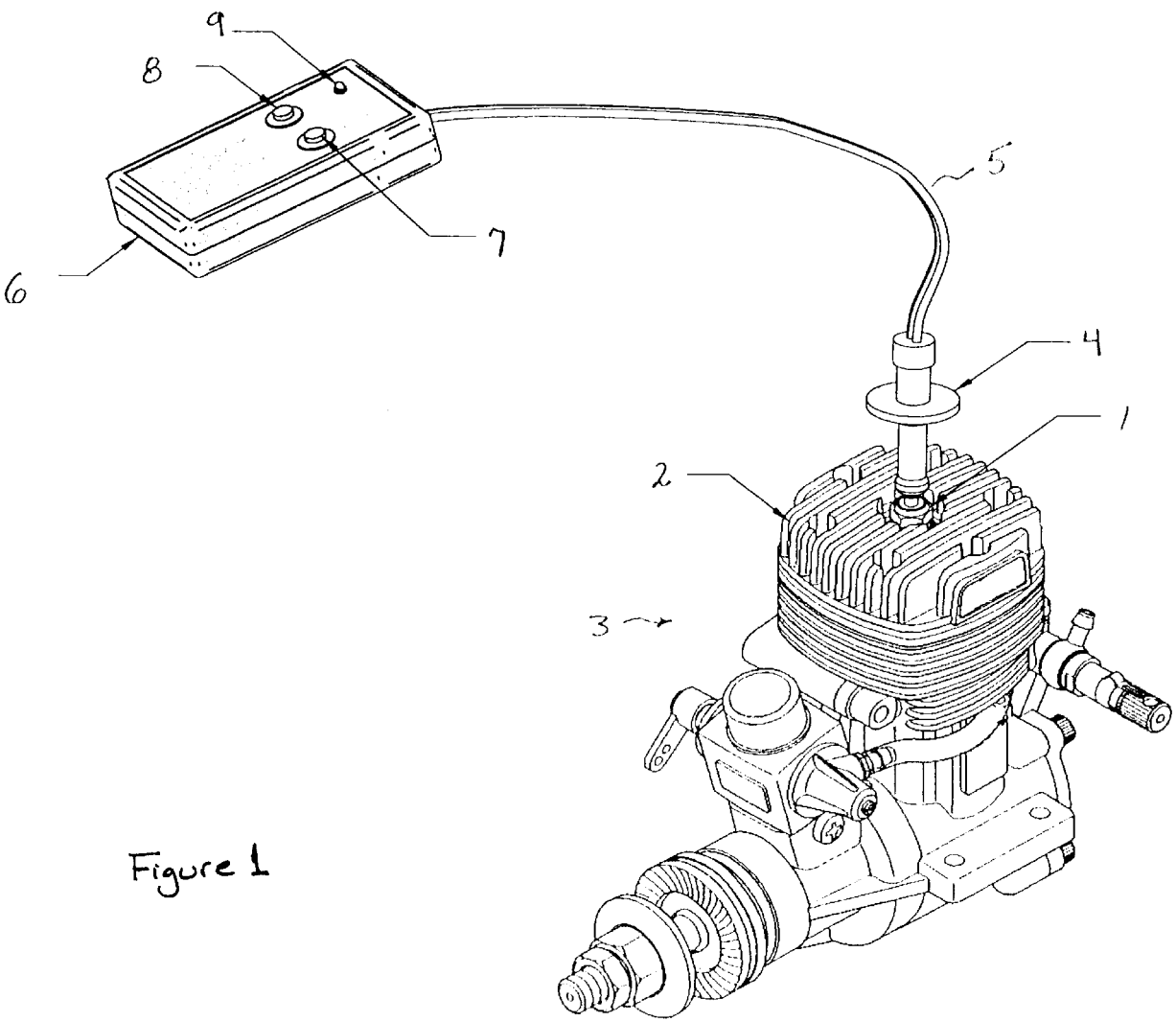
FIG. 1 is a perspective view of the glow plug energizer device according to one embodiment of the present invention.

FIG. 1 is a perspective view of the glow plug energizer device according to one embodiment of the present invention. In FIG. 1 a glow plug 1 is shown as being secured to the cylinder head 2 of a combustion engine 3. The combustion or "glow-ignition" engine 3 can be used to drive the propeller of a model airplane, or the propeller of a model boat or the drive axle of a model vehicle or other similar drive means of an engine driven model.

An attachable/releasable glow plug connector 4 is coupled to top of the glow plug 1 as depicted. Electrical leads 5 from the glow plug connector 4 are coupled to housing or casing 6 which contains a battery or batteries. A first manual switch 7 provided in housing or casing 6 couples the terminals of the battery or batteries through the electrical leads 5 to the glow plug 1 via glow plug connector 4 when the first manual switch 7 is operated.

A second manual switch 8 provided in housing or casing 6 couples the battery or batteries to a test light 9 which can be a light emitting diode (LED) or any small low-voltage light. In an alternative embodiment, an electrical meter display could be used in place of light 9.

Figure 2:
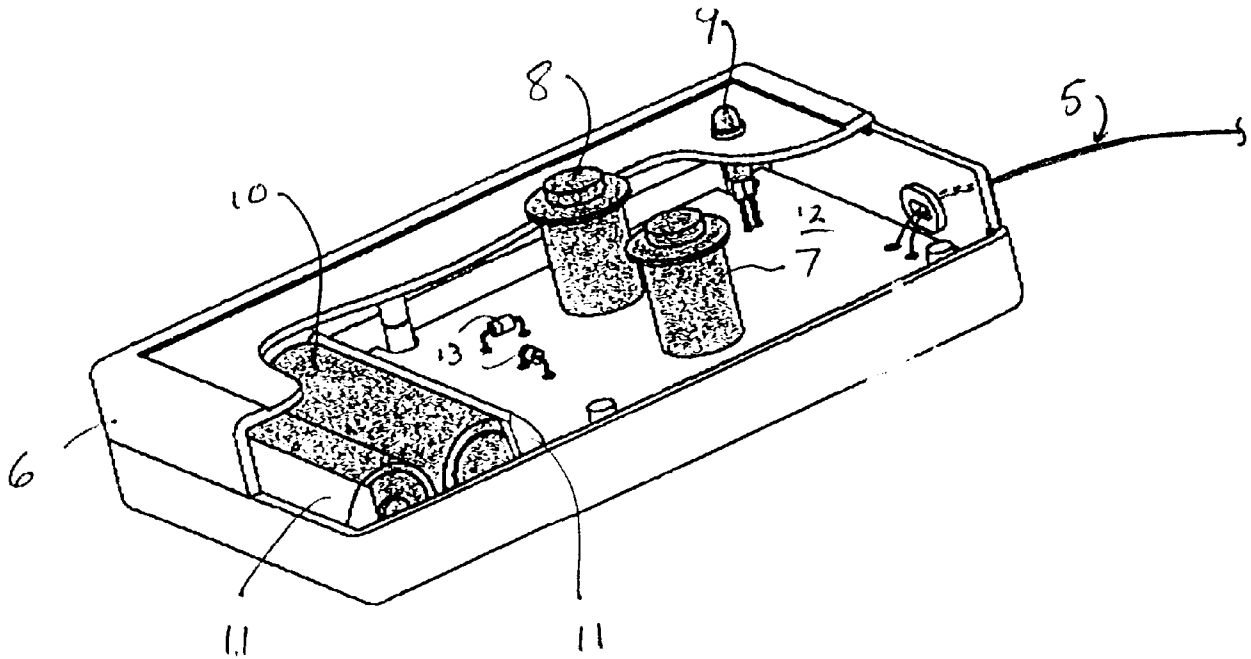
FIG. 2 is an opened perspective view of the housing or case of FIG. 1.

FIG. 2 is an opened perspective view of the housing or case of FIG. 1. In FIG. 2 a pair of batteries 10 are shown as being positioned in one end of housing or casing 6. The housing or casing 6 can be configured in a conventional manner, i.e., have partitioning structure(s) 11, to contain the batteries 10 in a desired area. The batteries 10 are coupled together in series and the positive terminal of one of the batteries 10 is coupled to each of first manual switch 7 and second manual switch 8 by electrical lines which are configured in circuit board 12. The negative terminal of the other battery is coupled to test light 9 by an electrical line provided in circuit board 12 and to one of the conductor pairs of electrical leads 5 by another line provided in circuit board 12. An additional electrical line provided in circuit board 12 connects between first manual switch 7 and the other of the conductor pairs of the electrical leads 5. A further electrical line provided in circuit board 12 connects between second manual switch 8 and test light 9, with a pair of resistors 13 provided in series therewith to regulate the voltage applied to test light 9. In this configuration, activating the first manual switch 7 (with glow plug connector 4 attached to a glow plug) completes an electrical circuit through which voltage from batteries 10 is applied to a glow plug. Activating second switch 8 closes an electrical circuit through which voltage from batteries 10 is applied to test light 9. If batteries 10 are significantly discharged the test light 9 will not light up, indicating that the batteries 10 need to be replaced or recharged. It the test light 9 does not light up one using the device will become aware that a glow plug connected to the device will not become energized enough to start an engine.

If a rechargeable battery or batteries is/are to be used, a convention charging circuit can be included in the housing or casing 6, including a plug-in port for receiving a terminal of a battery charger.

Figure 3:
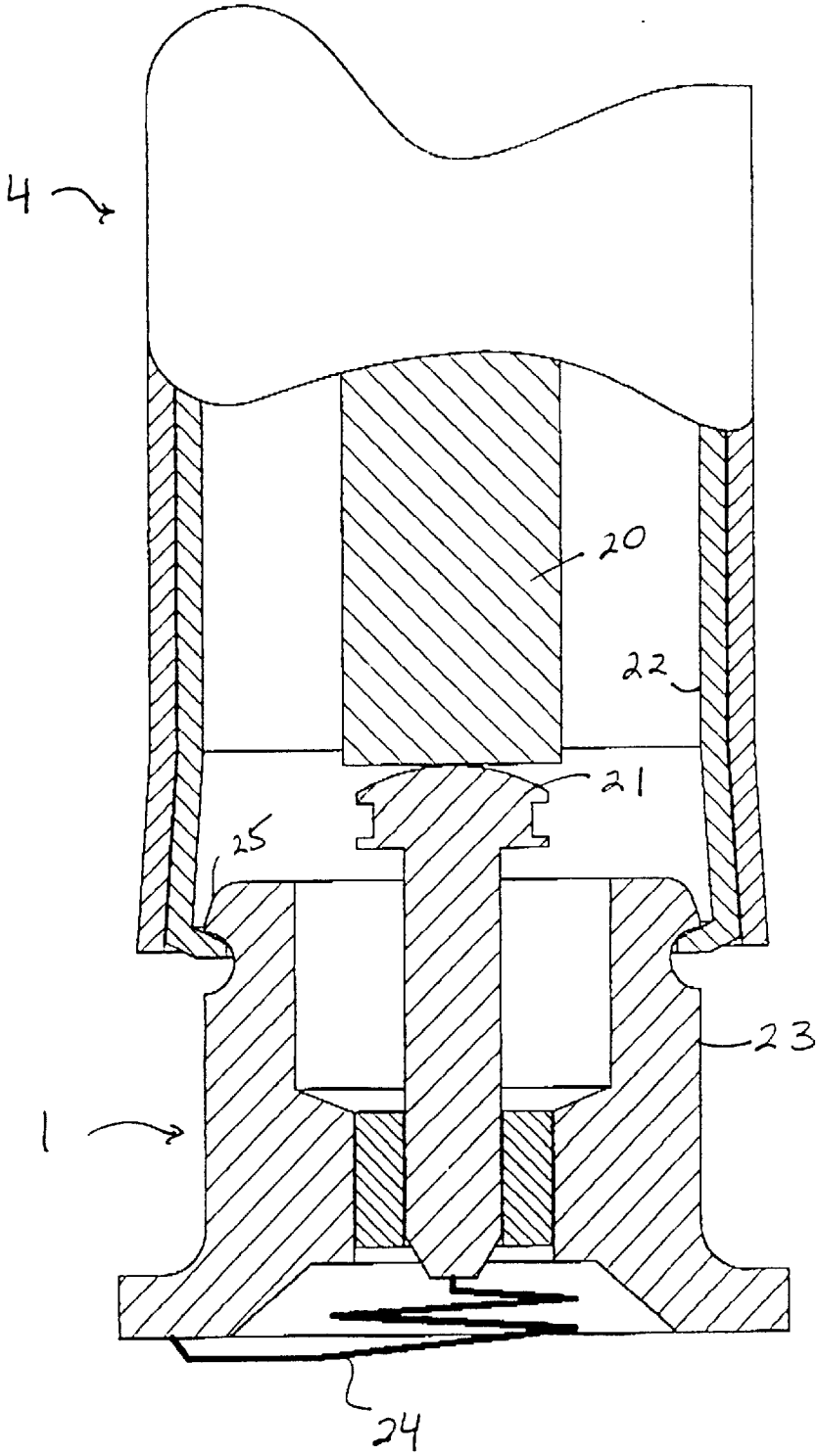
FIG. 3 is cross sectional view of the glow plug connector of FIG. 1 coupled to a glow plug.

FIG. 3 is cross sectional view of the glow plug connector of FIG. 1 coupled to a glow plug. As shown the central electrical terminal 20 of the glow plug connector 4 is configured to come into electrical contact with a first central conductor 21 of a glow plug 1, and an annular electrical terminal 22 of the glow plug connector 4 is configured to come into electrical contact with an outer wall 23 at the end of the glow plug 1 which serves as a second conductor of the glow plug 1. A platinum-alloy filament or coil 24 is coupled between the first and second conductors of the glow plug 1.

In order for the glow plug connector 4 to be easily attachable/releasable to/from a glow plug 1 the annular electrical terminal 22 can be configured to clip onto the outer wall 23 or end 25 of the glow plug 1. This can be accomplished by providing an interference or snap fit between either or both of the central electrical terminal 20 of the glow plug connector 4 and first central conductor 21 of a glow plug 1, and the annular electrical terminal 22 of the glow plug connector 4 and the outer wall 23 at the end of the glow plug 1. In addition, releasable connection features which are conventional in the art can also be incorporated into the glow plug connector 4 of the present invention.

Figure 4:
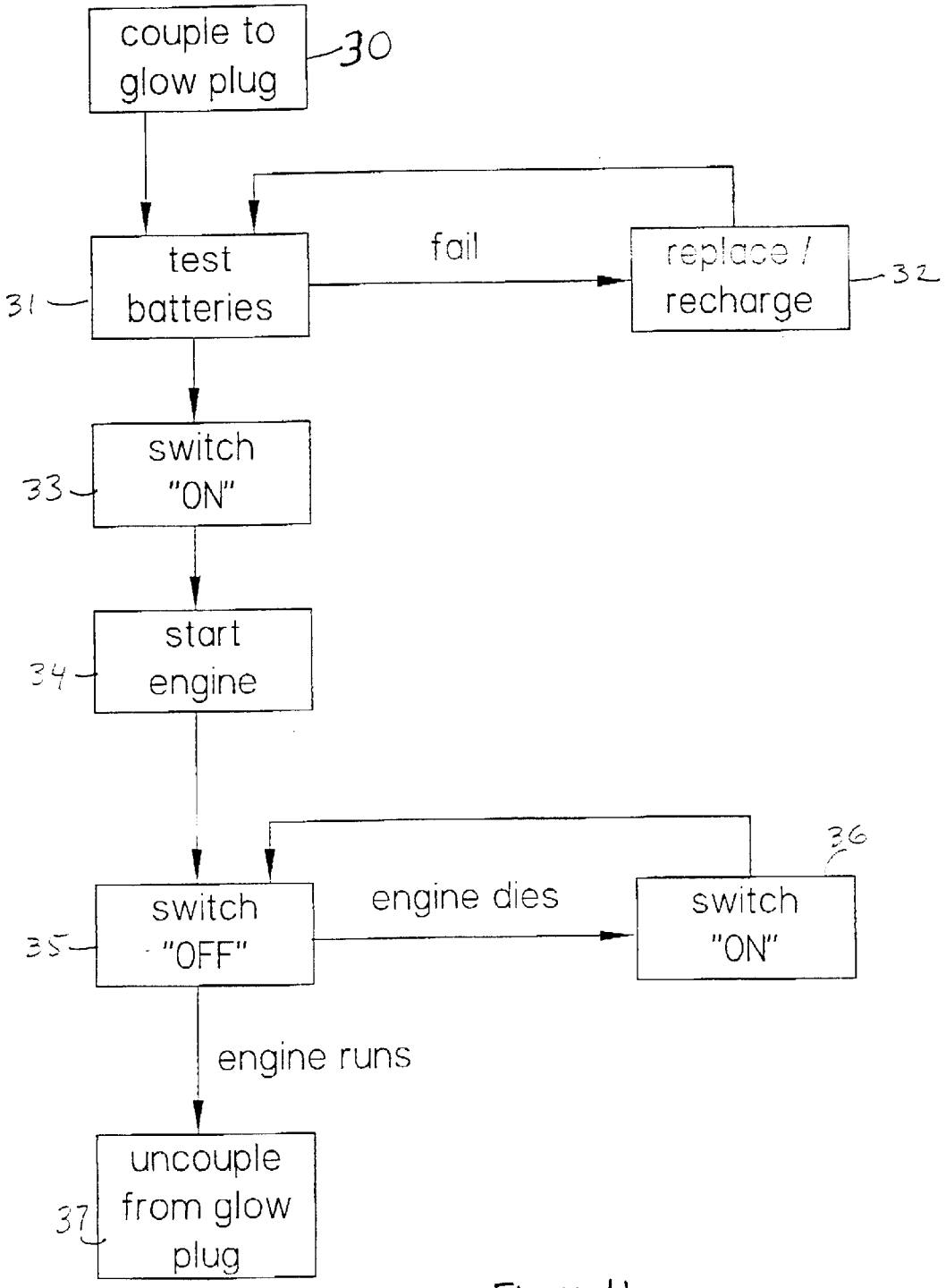
FIG. 4 is a flow diagram which depicts the manner in which the glow plug energizing device of the present invention is used.

FIG. 4 is a flow diagram which depicts the manner in which the glow plug energizing device of the present invention is used. Operation of the glow plug energizer of the present invention will be made with reference to FIGS. 1 and 4 together. In step 30 the glow plug connector 4 is releasably coupled to a glow plug 1. Next in step 31 the second manual switch 8 is moved to its ON position and a visual check of test light 9 is performed. If test light 9 indicates that the battery 10 is not sufficiently charged, the battery 10 is replaced or recharged in step 32. If the test light 9 indicates that the battery 10 is sufficiently charged, the operation proceeds to step 33.

In step 33 the first manual switch 7 is moved to its ON position and the engine 3 is started in the following step 34. After the engine 3 has been started in step 34, the first manual switch 7 is moved to its OFF position in step 35.

If the engine 3 begins to die in step 35 because it is too cold to maintain continuous operation or because adjustments need to be made to the air/fuel mixture, or because of other reasons, the first manual switch 7 is moved again into its ON position in step 36 and the engine 3 is allowed to operated with the glow plug 1 energized by the battery 10 for a short period of time.

Once the engine 3 achieves continuous self-sustained operation the glow plug connector 4 is disconnected from the glow plug 1 in step 37.

It can thus be appreciated how the glow plug energizing device can be used to assist in maintaining operation of a combustion or "glow-ignition" engine in circumstances wherein the engine typically dies while one may be attempting to reestablish electrical connection between a battery and the conductors of a glow plug.

That is, the present invention allows for continuous electrical connection between a battery and the conductors of a glow plug, and selective, one-hand manual energizing of the electrical connection.

An noted above, according to a further embodiment of the glow plug energizing device of the present invention, the first manual switch 7 can be placed in an intermediate location along the electrical leads 5 between the housing or casing 6 and the glow plug connector 4. In a further embodiment, the first manual switch 7 could be incorporated into the glow plug connector 4.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above.

What is claimed is:

1. A glow plug energizing device which comprises:

a glow plug connector configured to be releasably coupled to a glow plug;

at least one battery for supplying electrical energy to the glow plug connector;

a housing containing the at least one battery;

an electrical lead coupled between the housing and the glow plug connector; and a first manual switch coupled to the electrical lead for selectively applying electrical energy from the at least one battery to the glow plug connector without disconnecting the glow plug connector from the glow plug, said first manual switch being located in one of a position in the housing and a position along the electrical lead intermediately between the housing and the glow plug connector.

2. A glow plug energizing device according to claim 1, wherein the first manual switch is provided in the housing.

3. A glow plug energizing device according to claim 1, wherein the first manual switch comprises a momentary switch.

4. A glow plug energizing device according to claim 1, further comprising a battery test circuit including a second manual switch and a visual indicator.

5. A glow plug energizing device according to claim 4, wherein the visual indicator comprises a light.

6. A glow plug energizing device according to claim 1, wherein the at least one battery comprises a rechargeable battery.

7. A method of starting a glow-igntion engine which comprises the steps of:

a) providing a glow-ignition engine having a glow plug;

b) providing a glow plug energizing device which comprises:

a glow plug connector configured to be releasably coupled to a glow plug;

at least on battery for supplying electrical energy to the glow plug connector;

a housing containing the at least one battery;

an electrical lead couple between the housing and the glow plug connector; and a first manual switch coupled to the electrical lead for selectively applying electrical energy from the at least one battery to the glow plug connector without disconnecting the glow plug connector from the glow plug, said first manual switch being located in one of a position in the housing and a position along the electrical lead intermediately between the housing and the glow plug connector;

c) coupling the glow plug connector to the glow plug;

d) activating the first manual switch to energize the glow plug;

c) starting the glow-ignition engine;

f) deactivating the first manual switch; and g) removing the glow plug connector from the glow plug.

8. A method of starting a glow-ignition engine according to claim 7, wherein step d) is repeated after step f) if the glow-ignition engine starts to die after step f) is initially performed.

9. A method of starting a glow-ignition engine according to claim 7, wherein the first manual switch is provided in the housing.

10. A method of starting a glow-ignition engine according to claim 7, wherein the first manual switch is a momentary switch.

11. A method of starting a glow-ignition engine according to claim 7, further comprising providing the housing with a battery test circuit including a second manual switch and a visual indicator, and activating the second manual switch and observing the visual indicator to determine if the at least one battery is charged.

12. A method of starting a glow-ignition engine according to claim 11, wherein the visual indicator comprises a light.

13. A method of starting a glow-igition engine according to claim 7, wherein the glow-ignition engine is in one of a model vehicle, a model boat and a model aircraft.

* * * * *